US006244767B1

(12) United States Patent
Jung

(10) Patent No.: US 6,244,767 B1
(45) Date of Patent: Jun. 12, 2001

(54) IMAGE FORMING APPARATUS FOR PREVENTING PAPER JAM DURING CONTINUOUS PAPER RETURNING OPERATION

(75) Inventor: Young-Do Jung, Daegu (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/553,027

(22) Filed: Apr. 20, 2000

(51) Int. Cl.[7] ..... B41J 13/02
(52) U.S. Cl. ..... 400/636.2; 400/636
(58) Field of Search ..... 347/104; 400/605, 400/636, 636.2

(56) References Cited

U.S. PATENT DOCUMENTS

| | | | | |
|---|---|---|---|---|
| 3,941,230 | | 3/1976 | Bellino et al. . | |
| 4,004,749 | | 1/1977 | Strange . | |
| 5,032,033 | | 7/1991 | Stempfl . | |
| 5,461,460 | | 10/1995 | Lee . | |
| 5,727,784 | | 3/1998 | Sagawa . | |
| 5,746,525 | * | 5/1998 | Sanda et al. | 400/605 |
| 5,775,824 | * | 7/1998 | Bae | 400/636 |
| 5,867,196 | * | 2/1999 | Kiyohara | 347/104 |

* cited by examiner

*Primary Examiner*—John S. Hilten
*Assistant Examiner*—Marvin P. Crenshaw
(74) *Attorney, Agent, or Firm*—Robert E. Bushnell, Esq.

(57) ABSTRACT

An improved image forming apparatus is provided for performing a printing operation on a series of paper and having a serial paper feeding device and a single sheet feeding device. The apparatus causes no paper jams of the series of paper while returning the series of paper to switch from a serial paper feeding mode to a single sheet feeding mode. The image forming apparatus includes a tractor wheel for conveying a series of paper to a printing area and for retreating the series of paper, and a tractor shaft for pivoting the tractor wheel. The image forming apparatus for feeding the series of paper by a serial paper feeding device causes a certain backlash in an initial pivotal movement of the tractor wheel and the tractor shaft. The image forming apparatus for preventing a paper jam during a retreating of the series of paper further includes an eject roller for feeding or retreating the paper which is conveyed by the serial paper feeding device by a forward and backward rotation thereof; an eject shaft for providing rotational force to the eject roller; an eject gear for causing a backlash at the eject shaft and the eject roller in the initial pivotal movement thereof, the eject gear for providing the rotational force to the eject shaft; a backlash hole formed in a certain location of the eject gear to race for causing the backlash at the eject gear in an initial pivotal movement; and a shaft pin fixed on the eject shaft after being passed through the backlash hole, for transmitting the rotational force of the eject gear to the eject shaft, thereby driving the eject shaft.

21 Claims, 4 Drawing Sheets

IMAGE FORMING APPARATUS FOR PREVENTING PAPER JAM DURING CONTINUOUS PAPER RETURNING OPERATION

BACKGROUND OF THE INVENTION

1. Field of the Invention

The present invention relates to an improved image forming apparatus having a serial paper feeding device and a single sheet feeding device which is capable of safely returning a series of paper at a printing area back to the serial paper feeding device without causing any paper jam when switching from a serial paper feeding mode to a single sheet feeding mode.

2. Description of the Related Art

Generally, an image forming apparatus such as an ink jet printer, etc. employs a single sheet feeding device for feeding sheets of paper one by one, and a serial paper feeding device for successively and continuously feeding the paper for printing. The single sheet and serial paper feeding devices are selectively mounted on the image forming apparatus depending on the need of the user.

Accordingly, for several purposes such as switching the serial paper feeding mode into the single sheet feeding mode, the image forming apparatus is provided with a function of retreating the serial paper from the printing area back to the serial paper feeding device, which is called the "parking" function.

During the parking operation, all the rotatable rollers inclusive of a tractor are reversely rotated. However, due to unbalanced movements of the respective parts, the paper is not safely returned to the tractor but is folded and separated from the tractor, causing the state called a "paper jam".

Referring to FIG. 1, in order to use a series of paper (P), a serial paper feed selection lever 1 is rotated in the direction indicated by a solid arrow. Accordingly, a cam shaft 2 is rotated to push a friction guide 3, and to lift a friction roller 4 for the conveyance of a single sheet.

In the single sheet feeding mode, the series of paper (P) is not affected by the movement of the feed roller 5 and the friction roller 4. Next, by rotating the tractor wheel 6 clockwise, the serial paper (P) secured between an eject roller 7 and a star eject wheel 8 is returned by the tractor wheel 6 which pulls the serial paper (P).

Further, in order to prevent a paper jam at the series of paper (P), the eject roller 7 is designed to have a slightly faster rotational speed than the tractor wheel 6. That is, by the speed difference, the paper (P) is smoothed. Here, since a slip occurs between the eject roller 7 and the eject wheel 8 to correspond to an extra conveyance distance of the paper (P), the series of paper (P) can be successively conveyed without having any problem even with the different speeds of the respective rollers.

In the serial paper feeding device, the tractor wheel 6 is movable leftward and rightward according to the width of the paper by a tractor shaft 9. By the structural need, there has to be a clearance (or space) between the tractor wheel 6 and the tractor shaft 9, and accordingly, a "backlash" is caused in the initial driving in which only the tractor shaft 9 rotates while the tractor wheel 6 does not.

Meanwhile, as shown in FIG. 2, since the eject roller 7, an eject shaft 10 for transmitting the driving force to the eject roller 7, and an eject gear 11 are securely press-fitted with each other. There is almost no backlash.

Accordingly, referring back to FIG. 1, when the series of paper (P) advancing to the forward direction (direction for the printing operation) is reversely retreated for the parking operation, the eject roller 7 reversely conveys the series of paper (P) even though a backlash is caused, i.e., even though the tractor wheel 6 is not rotated in its initial operation. Accordingly, since the tractor wheel 6 does not convey the series of paper as the eject roller 7 does, the series of paper (P) is folded as indicated by the dotted line, while the parking operation is kept on being performed. As a result, the series of paper is separated from the tractor wheel 6. By such a paper jam, there has been a reliability deterioration of the image forming apparatus.

SUMMARY OF THE INVENTION

The present invention has been developed to overcome the above-mentioned problems of the related art, and accordingly, it is an object of the present invention to provide an image forming apparatus capable of performing a parking operation to return a series of paper to a tractor without causing any paper jam.

In order to accomplish the above object, the present invention prevents paper folding in an initial parking operation, which is caused due to different backlash at the tractor and the eject roller, by defining a racing space between the eject roller and the eject gear, i.e., by balancing the backlash at the tractor wheel and the eject roller.

Accordingly, in an image forming apparatus including a tractor wheel for conveying a series of paper to a printing area and for retreating the series of paper, and a tractor shaft for pivoting the tractor wheel, the image forming apparatus for feeding the series of paper by a serial paper feeding device which causes a certain backlash in an initial pivotal movement of the tractor wheel and the tractor shaft, the image forming apparatus for preventing a paper jam during a retreating of the series of paper according to the present invention further includes an eject roller for feeding or retreating the paper which is conveyed by the serial paper feeding device by a forward and backward rotation thereof; an eject shaft for providing rotational force to the eject roller; an eject gear for causing a backlash at the eject shaft and the eject roller in the initial pivotal movement thereof, the eject gear for providing the rotational force to the eject shaft; a backlash hole formed in a certain location of the eject gear to race for causing the backlash at the eject gear in an initial pivotal movement; and a shaft pin secured on the eject shaft after being passed through the backlash hole, for transmitting the rotational force of the eject gear to the eject shaft, thereby driving the eject shaft.

The image forming apparatus according to the present invention further includes an elasticity providing section for providing a certain degree of frictional force to the eject gear so as to cause a certain consistent backlash at the eject gear which is moved with respect to the eject shaft.

Further, the elasticity providing section includes a compression elastic member for providing an elasticity to the eject shaft; an elasticity applied member secured on the eject shaft for receiving and transmitting the elasticity of the compression elastic member to the eject shaft; and a sealing member for exerting the elasticity transmitted to the eject shaft to the eject gear.

Further, the backlash at the tractor wheel equals to the backlash at the eject gear.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

The apparatus according to the preferred embodiment will be described in greater detail with reference to the accompanying drawings.

Figure 1:
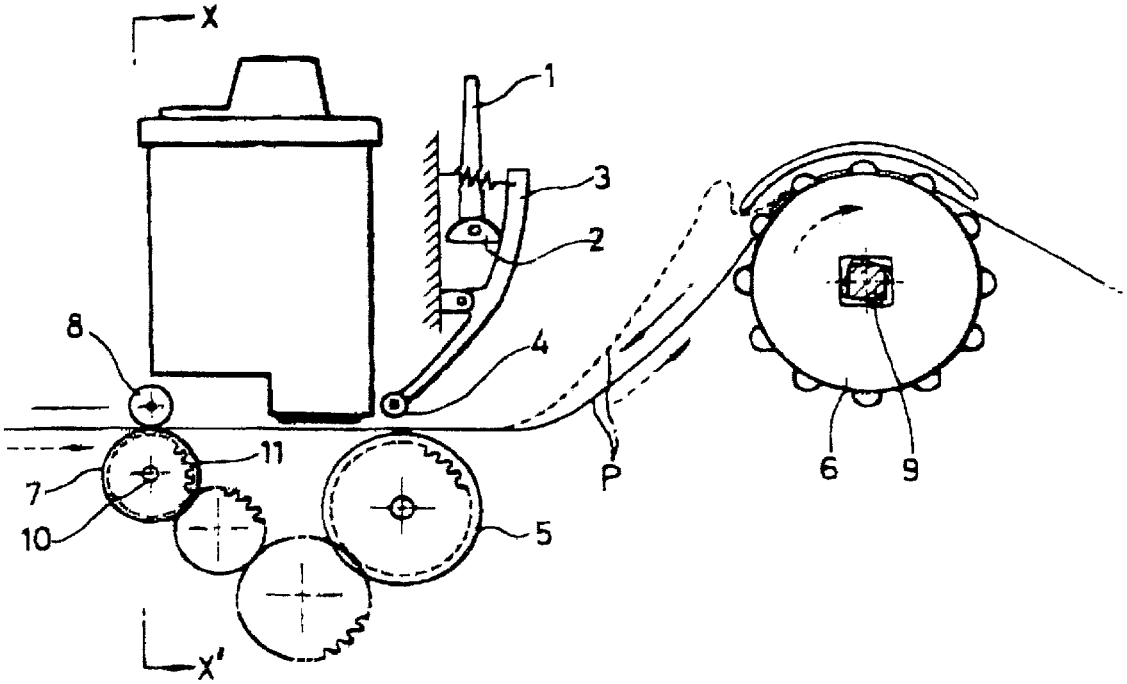
FIG. 1 is a schematic view for explaining a conventional image forming apparatus having a serial paper feeding device.
Figure 2:
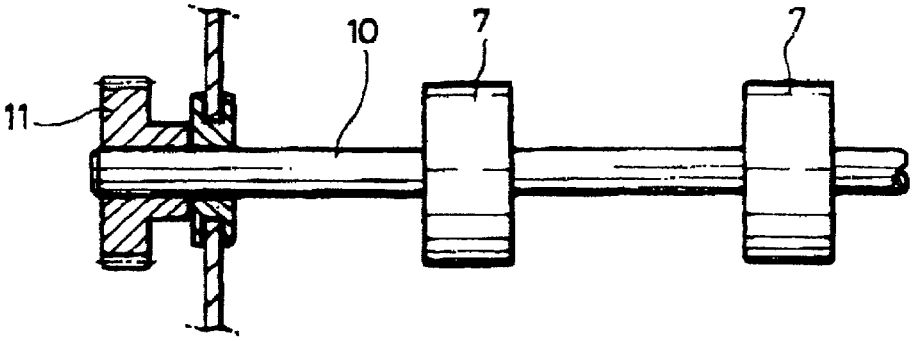
FIG. 2 is an enlarged sectional view taken on line X-X' of FIG. 1.
Figure 3:
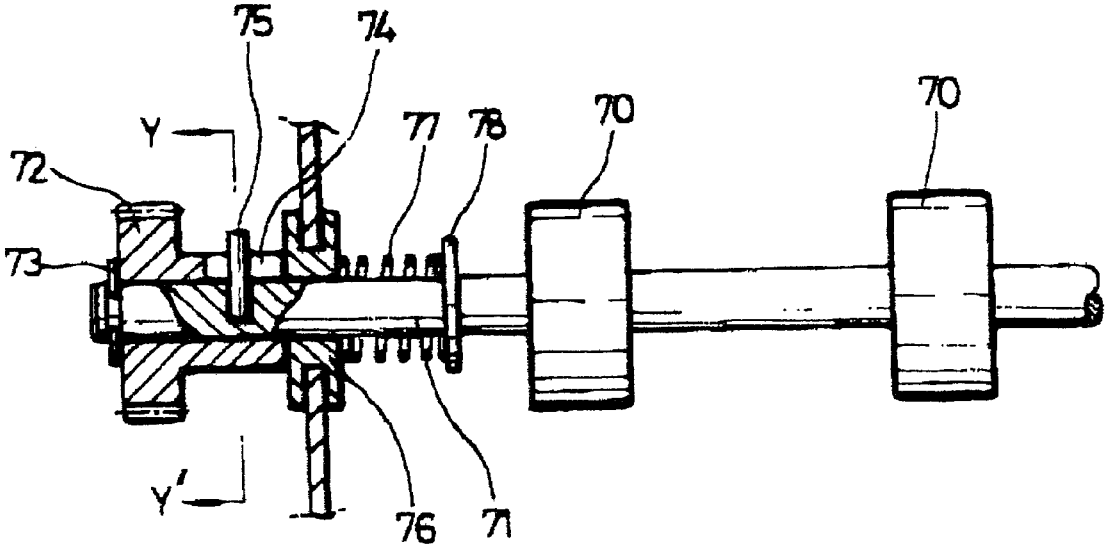
FIG. 3 is a sectional view for showing an eject roller according to the present invention.
Figure 4:
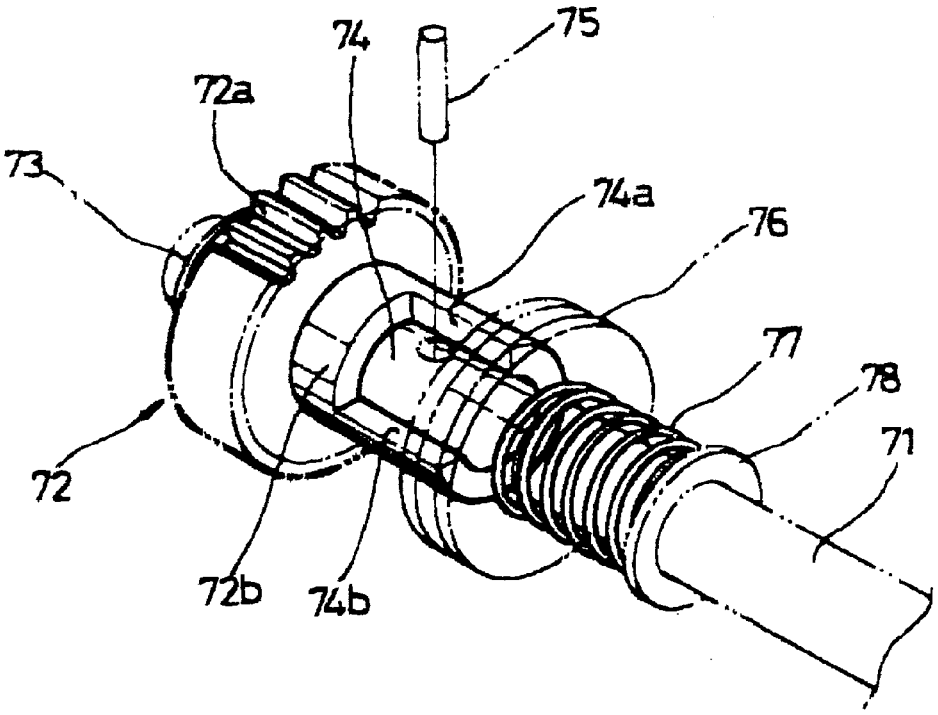
FIG. 4 is a perspective view for showing the main portion of the eject roller of FIG. 3.

FIGS. 3 and 4 show the apparatus for preventing paper folding in an initial parking operation, which is caused due to different backlash at the tractor wheel 6 and the eject roller 70.

Referring to FIGS. 3 and 4, since the eject roller 70 is secured on the eject shaft 71, the eject roller 70 is rotated according to the rotational movement of the eject shaft 71.

The eject shaft 71 is passed through a shaft boss 76 supported on a frame (12), and is connected to an eject gear 72 disposed on one end thereof for transmitting the driving force. The eject gear 72 is designed to race on the eject shaft 71, and is secured on the eject shaft 71 by a sealing member 73 which is secured on the outer side of the eject gear 72 to prevent the separation of the eject gear 72. The sealing member 73 is preferably made of an E-ring.

The eject gear 72 includes a gear section 72*a* and a boss section 72*b*. The gear section 72*a* is engaged with an idle gear 80 for transmitting the driving force, and the boss section 72*b* transmits the driving force to the eject shaft 71.

Accordingly, the boss section 72*b* includes a backlash hole 74 for causing the backlash. Further, a shaft pin 75 is secured on the eject shaft 71 after being passed through the backlash hole 74 to transmit the rotational force of the eject gear 72 to the eject shaft 71.

Further, there is provided a compression elastic member 77 opposed to the eject gear 72 while a shaft boss 76 is located between the compression elastic member 77 and the eject gear 72. The compression elastic member 77 is disposed on the eject shaft 71 to subject the eject shaft 71 to a certain degree of frictional force in a longitudinal direction of the eject shaft 71, to thereby secure a constant backlash occurrence thereat. An elasticity applied member 78 is secured on the outer side of the eject shaft 71 to be subjected to the elasticity of the compression elastic member 77.

Therefore, the elasticity applied member 78 is subjected to the force from the compression elastic member 77, to continuously push the eject shaft 71 in the opposite direction from the eject gear 72. Accordingly, the sealing member 73 presses the eject gear 72 into tight contact with the shaft boss 76, generating frictional force therebetween. Since frictional force is generated while the eject gear is in tight contact with the shaft boss 76, vibration is prevented.

In case the eject gear 72 uncontrollably rotates or vibrates, a consistent degree of backlash is not obtained, hindering the achievement of the object of the present invention. That is, in FIG. 4, the backlash corresponds to the distance from one end 4*a* to the other end 4*b* of the backlash hole 74. Accordingly, in the event that the eject gear 72 uncontrollably rotates on the eject shaft 71 to permit the driving force transmission in a state that the shaft pin 75 is approximately in the middle portion of the backlash hole 74, the backlash corresponds to the distance from the shaft pin 75 to end 74*a* end or the other end 74*b* of the back lash hole 74. Accordingly, the backlash degree is not enough to satisfy the object of the present invention, and the object of the present invention cannot be achieved.

According to the present invention, however, since the elasticity of the compression elastic member 77 pulls the eject gear 72 toward the shaft boss 76, the frictional force is exerted between the eject gear 72 and the shaft boss 76 to control the rotation of the eject gear 72 on the eject shaft 71. As a result, a consistent degree of backlash, which corresponds to the distance from one end 74*a* to the other end 74*b* of the backlash hole 74, can be obtained.

Figure 5:
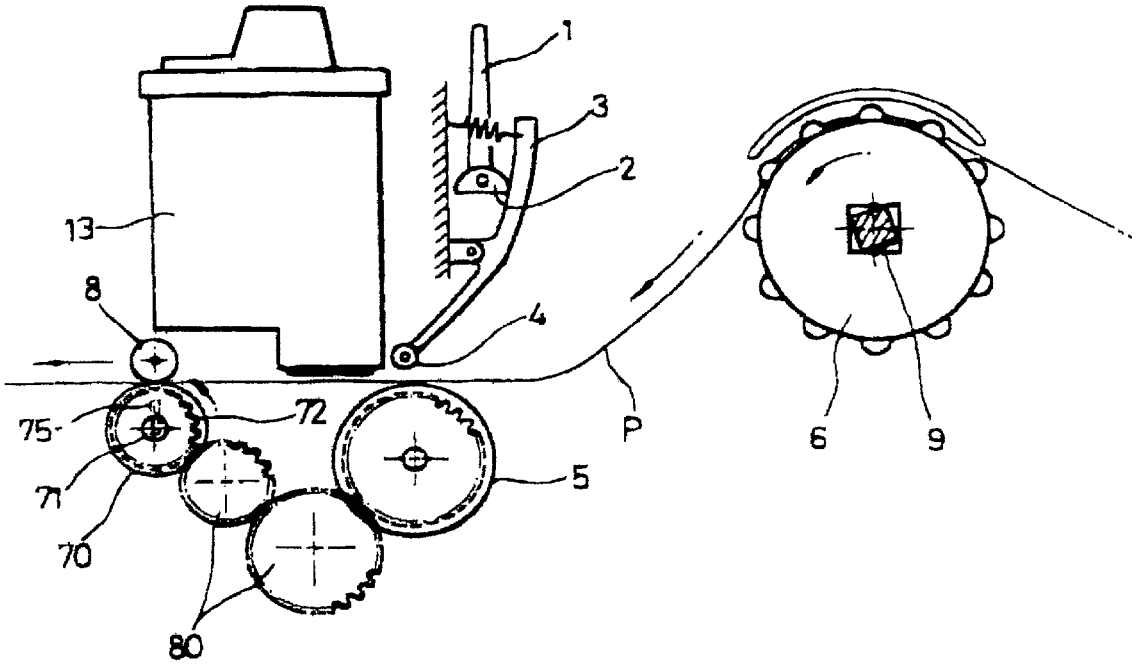
FIG. 5 is a schematic view for showing the apparatus performing a forward directional conveyance of series of paper according to the present invention.

FIG. 5 shows the operation of the present invention during the printing operation. In this situation, the tractor wheel 6 and the eject roller 70 rotate counterclockwise, i.e., a "forward direction". Accordingly, the series of paper (P) is fed in the forward direction, while the image is printed on the paper by an ink head 13.

Figure 6:
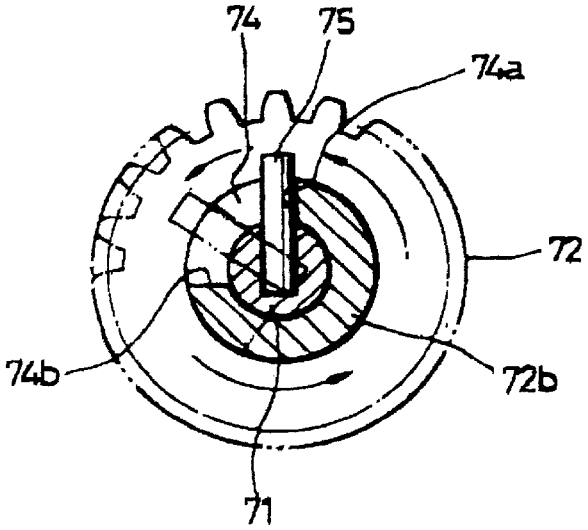
FIG. 6 is an enlarged sectional view taken on line Y-Y' of FIG. 3, for showing the operation of the apparatus of FIG. 5.

Further, as shown in FIG. 6, as the shaft pin 75 is clicked with one end 74*a* of the backlash hole 74 during the printing operation, the eject roller 70 and the eject shaft 71 are rotated forward to pull the series of paper (P) in cooperation with the eject wheel 8.

Figure 7:
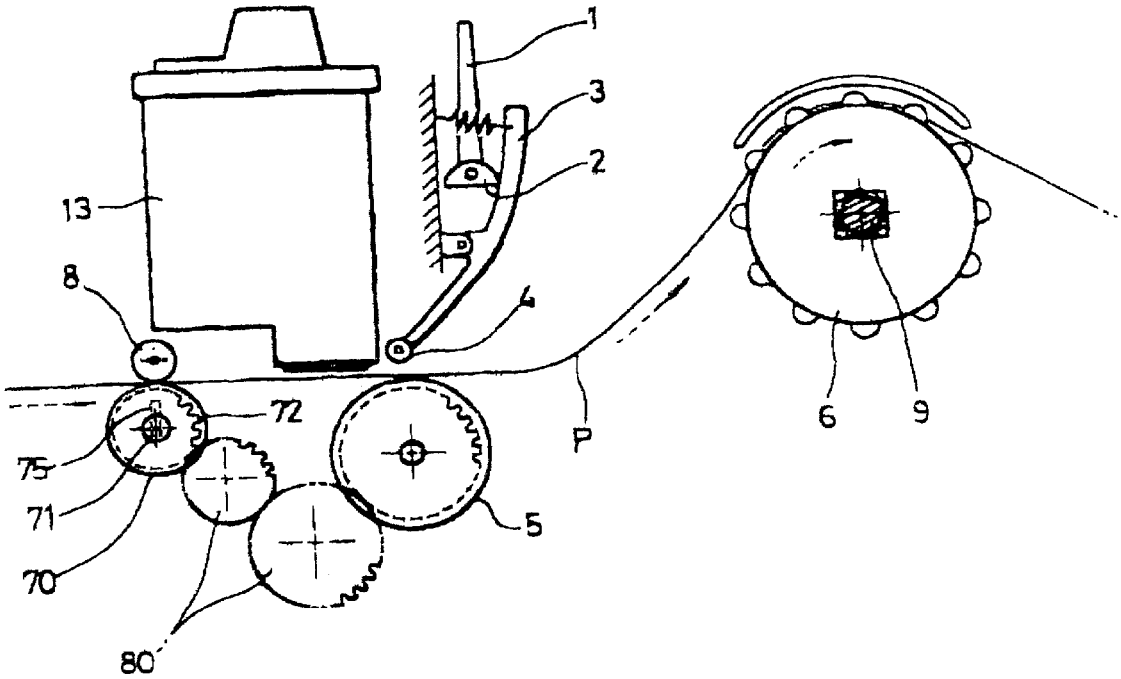
FIG. 7 is a schematic view for showing the apparatus performing a backlash action according to the present invention.

Referring to FIG. 7, when receiving a paper retreating command after the printing operation, the image forming apparatus (printer) rotates the tractor shaft 9 in the reverse direction (clockwise direction). Initially, due to the presence of the clearance (space) between the tractor shaft 9 and the tractor wheel 6, the backlash is caused until the tractor shaft 9 is clicked with the tractor wheel 6. That is, only the tractor shaft 9 is rotated while the tractor wheel 6 is not. Simultaneously with this, the backlash is also caused at the eject roller 70.

More specifically, when the tractor shaft 9 is reverse-rotated, the eject gear 72 is also reverse-rotated. Here, the backlash is caused during the initial reverse-rotation, which means the eject gear 72 races while the eject shaft 71 is not rotated.

Figure 8:
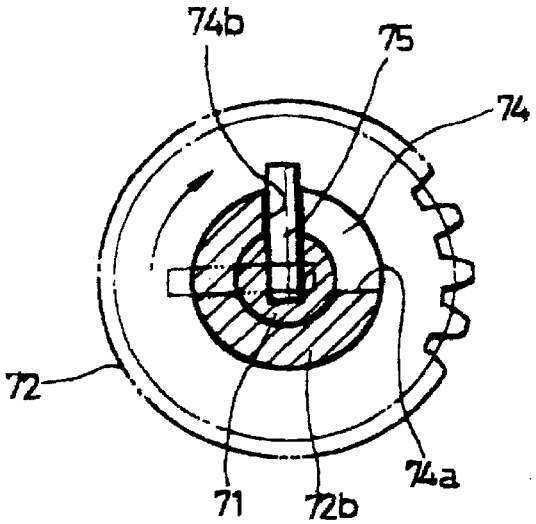
FIG. 8 is an enlarged sectional view taken on line Y-Y' of FIG. 3 for showing the operation of the apparatus of FIG. 7.

Referring to FIG. 8, by the reverse-rotation (clockwise direction) of the eject gear 72, the shaft pin 75 leaves from one end 74*a* of the backlash hole 74 to be clicked with the other end 74*b* of the backlash hole 74. When the shaft pin 75 is clicked with the other end 74*b* of the backlash hole 74, the driving force is transmitted to reverse-rotate the eject shaft 71. Here, the backlash corresponds to the distance from one end 74*a* to the other end 74*b* of the back lash hole 74.

The backlash at the eject gear 72 corresponds to the back lash at the tractor wheel 6. Accordingly, in the initial operation, the tractor wheel 6 and the eject roller 70 are not rotated for a certain period of time, and are simultaneously rotated after the completion of the backlash action. As a result, the parking operation for the series of paper (P) is performed without the paper folding.

Further, when the feeding operation is performed after the parking operation, since there is a sufficient distance between the paper and the eject roller, the backlash caused at the eject gear does not affect the feeding operation.

As described above, according to the present invention, since the parking operation for the series of paper is performed without the paper folding, the paper jam is prevented, and the product reliability is improved.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. An image forming apparatus, comprising;

a tractor wheel conveying a series of printable medium to a printing area and retreating the series of printable medium;

a tractor shaft pivoting said tractor wheel, feeding the series of printable medium by a feeding device having a certain backlash in an initial pivotal movement of said tractor wheel and said tractor shaft;

a first roller feeding or retreating the series of printable medium conveyed by the feeding device by a forward and backward rotation of said first roller, said first roller ejecting said printable medium from said image forming apparatus;

a shaft providing rotational force to said first roller;

a first gear causing a backlash at said shaft and said first roller in the initial pivotal movement of said first gear, said first gear providing the rotational force to said shaft, a hole formed in a certain location of said first gear, the hole accommodating said first gear to race and have a backlash at said first gear in an initial pivotal movement of said first gear; and a shaft pin secured on said shaft after being passed through the hole, said shaft pin transmitting the rotational force of said first gear to said shaft, the rotational force driving said shaft.

2. The image forming apparatus as claimed in claim 1, further comprising an elasticity providing unit having a certain degree of frictional force to said first gear, the certain degree of friction force providing a certain consistent backlash at said first gear, said first gear being moved with respect to said shaft.

3. The image forming apparatus as claimed in claim 2, with said elasticity providing unit comprising:

a compression elastic member providing an elasticity to said shaft;

an elasticity applied member secured on said shaft receiving and transmitting the elasticity of said compression elastic member to said shaft; and a sealing member exerting the elasticity transmitted to said shaft to said first gear.

4. The image forming apparatus as claimed in claim 1, with the backlash at said tractor wheel equal to the backlash at said first gear.

5. The image forming apparatus of claim 1, with said first gear comprising:

a gear section engaged with an idle gear and transmitting a driving force; and a boss section transmitting the driving force to said shaft, said boss section including the hole.

6. The image forming apparatus of claim 5, further comprising a shaft boss located between said compression elastic member and said first gear.

7. The image forming apparatus of claim 6, with said sealing member pressing said first gear into contact with said shaft boss, said sealing member generating frictional force between said fist gear and said shaft boss, the generated frictional force preventing vibration.

8. The image forming apparatus of claim 7, with said elasticity applied member secured on an outer side of said shaft.

9. The image forming apparatus of claim 8, with the elasticity of said compression elastic member pulling said first gear toward said shaft boss, the frictional force being exerted between said first gear and said shaft boss to control a rotation of said first gear on said shaft, a consistent degree of backlash being from the frictional force.

10. The image forming apparatus of claim 9, with said first roller being secured to said shaft.

11. An apparatus preventing jams of printable medium in an image forming device, comprising:

a first roller feeding a continuous series of printable medium by a forward and backward rotation of said first roller, the continuous series of printable medium being conveyed to said first roller by a feeding device, said first roller ejecting said printable medium;

a shaft being passed through a shaft boss supported on a frame;

a first gear disposed on an end of said shaft, said first gear transmitting a driving force on said shaft, said first roller secured to said shaft, said first gear providing a backlash at said shaft and said first roller, a hole formed in a certain location of said first gear, the hole accommodating said first gear to race and have a backlash at said first gear;

a sealing member secured on an outer side of said first gear preventing separation of said first gear from said shaft;

a shaft pin secured on said shaft after being passed through the hole to transmit the rotational force of said first gear to said shaft;

a compression elastic member opposed to said first gear, said compression elastic member being disposed on said shaft to subject said shaft to a certain degree of frictional force in a longitudinal direction of said shaft to secure a constant backlash;

a shaft boss being located between said compression elastic member and said first gear, said sealing member pressing said first gear into tight contact with said shaft boss, said sealing member generating frictional force between said first gear and said shaft boss, the generated frictional force preventing vibration; and an elasticity applied member secured on an outer side of said shaft, said elasticity applied member being subjected to the elasticity of said compression elastic member, the elasticity of said compression elastic member pulling said first gear toward said shaft boss, the frictional force being exerted between said first gear and said shaft boss to control a rotation of said first gear on said shaft, a consistent degree of backlash being from the frictional force.

12. The apparatus of claim 11, with said first gear providing a backlash at said shaft and said first roller in an initial pivotal movement of said first gear.

13. The apparatus of claim 12, with said first gear comprising:

a gear section engaged with an idle gear transmitting a drive force; and a boss section transmitting the driving force to said shaft, said boss section including the hole providing the backlash.

14. The apparatus of claim 13, with said sealing member having an e-ring.

15. The apparatus of claim 14, with said elasticity applied member subjected to the force from said compression elastic member to continuously push said shaft in the opposite direction from said first gear.

16. The apparatus of claim 15, further comprising:

a tractor wheel conveying the continuous series of printable medium to a printing area and retreating the continuous series of printable medium;

a tractor shaft pivoting said tractor wheel; and said feeding device feeding the continuous series of printable medium having a certain backlash in an initial pivotal movement of said tractor wheel and said tractor shaft.

17. The apparatus of claim 16, with the backlash at said tractor wheel equal to the backlash at said first gear.

18. A method of preventing jams of printable medium during a retreating of a continuous series of printable medium, comprising the steps of:

conveying by a tractor wheel the continuous series of printable medium to a printing area and retreating the continuous series of printable medium;

pivoting said tractor wheel by a tractor shaft;

feeding the continuous series of printable medium by a feeding device having a certain backlash in an initial pivotal movement of said tractor wheel and said tractor shaft;

feeding or retreating the continuous series of the printable medium by a first roller conveyed by the feeding device by a forward and backward rotation of said first roller, said first roller ejecting said printable medium;

providing rotational force by a shaft to said first roller;

initiating a backlash by a first gear at said shaft and said first roller in the initial pivotal movement of said first gear, said first gear providing the rotational force to said shaft;

providing the backlash by a hole formed in a certain location of said first gear, the hole accommodating said first gear to race and have the backlash at said first gear in an initial pivotal movement of said first gear; and transmitting the rotational force of said first gear to said shaft by a shaft pin, the rotational force driving said shaft, said shaft pin secured on said shaft after being passed through the hole.

19. The method of claim 18, further comprising of providing a certain degree of frictional force to said first gear by an elasticity providing unit, the certain degree of friction force providing a certain consistent backlash to said first gear, said first gear being moved with respect to said shaft.

20. The method of claim 19, with said elasticity providing unit comprising of:

a compression elastic member providing an elasticity to said shaft;

an elasticity applied member secured on said shaft receiving and transmitting the elasticity of said compression elastic member to said shaft; and a sealing member exerting the elasticity transmitted to said shaft to said gear.

21. The method of claim 20, with the backlash at said tractor wheel equal to the backlash at said first gear.

* * * * *